US006282997B1

(12) United States Patent
Frazer

(10) Patent No.: US 6,282,997 B1
(45) Date of Patent: Sep. 4, 2001

(54) MULTIPURPOSE TOOL AND COMPONENTS THEREOF

(75) Inventor: Spencer Frazer, Edmonds, WA (US)

(73) Assignee: SOG Specialty Knives, Inc., Lynnwood, WA (US)

( * ) Notice: Subject to any disclaimer, the term of this patent is extended or adjusted under 35 U.S.C. 154(b) by 0 days.

(21) Appl. No.: 09/335,624

(22) Filed: Jun. 18, 1999

Related U.S. Application Data

(63) Continuation-in-part of application No. 09/157,780, filed on Sep. 21, 1998, now Pat. No. 6,003,180, which is a continuation of application No. 08/761,428, filed on Dec. 6, 1996, now Pat. No. 5,809,599, which is a continuation of application No. 08/479,469, filed on Jun. 7, 1995, now abandoned, which is a continuation-in-part of application No. 08/292,578, filed on Aug. 19, 1994, now abandoned, which is a continuation-in-part of application No. 08/158,894, filed on Nov. 29, 1993, now abandoned.

(51) Int. Cl.[7] ..... B25B 7/00; B25B 7/22

(52) U.S. Cl. ..... 81/427.5; 81/177.4; 81/177.6; 81/177.7; 7/128; 7/168

(58) Field of Search ..... 81/427.5, 177.4, 81/177.6, 177.7; 30/255, 153; 7/118, 167, 168, 128, 129

(56) References Cited

U.S. PATENT DOCUMENTS

| | | | |
|---|---|---|---|
| 3,568,315 | | 3/1971 | Smith . |
| 3,783,509 | | 1/1974 | Lake . |
| 4,040,181 | | 8/1977 | Johnson . |
| 4,203,208 | | 5/1980 | Tausendfreundt et al. . |
| 4,238,862 | * | 12/1980 | Leatherman ..... 7/128 |
| 4,347,665 | | 9/1982 | Glesser . |
| 4,442,600 | | 4/1984 | Felix-Dalichow . |
| 4,535,539 | | 8/1985 | Friedman et al. . |
| 4,669,188 | | 6/1987 | Evrell . |
| 4,744,272 | * | 5/1988 | Leatherman ..... 7/128 X |
| 5,044,079 | | 9/1991 | Gibbs . |
| 5,210,950 | | 5/1993 | Rankl . |
| 5,511,310 | | 4/1996 | Sessions et al. . |
| 5,916,277 | * | 6/1999 | Dallas ..... 7/128 |
| 5,946,752 | | 9/1999 | Parrish . |
| 5,957,013 | | 9/1999 | Frazer . |
| 6,009,582 | | 1/2000 | Harrison et al. . |
| 6,014,787 | | 1/2000 | Rivera . |
| 6,047,426 | | 4/2000 | McIntosh et al. . |

FOREIGN PATENT DOCUMENTS

| | | |
|---|---|---|
| EP 0 714 736 A1 | 6/1996 | (EP) . |

* cited by examiner

*Primary Examiner*—D. S. Meislin
(74) *Attorney, Agent, or Firm*—Christensen O'Connor Johnson Kindness PLLC

(57) ABSTRACT

A multipurpose tool having pivoted jaws is provided. Elongated handles are attached to the butt end of each jaw. The handles are channel shaped and define recesses into which the interconnected jaw members can be swung or retracted so as to be nested in the handles. Handle covers are pivoted to each handle and include an opening through which the jaw members pass when moved between the open and closed positions.

2 Claims, 17 Drawing Sheets

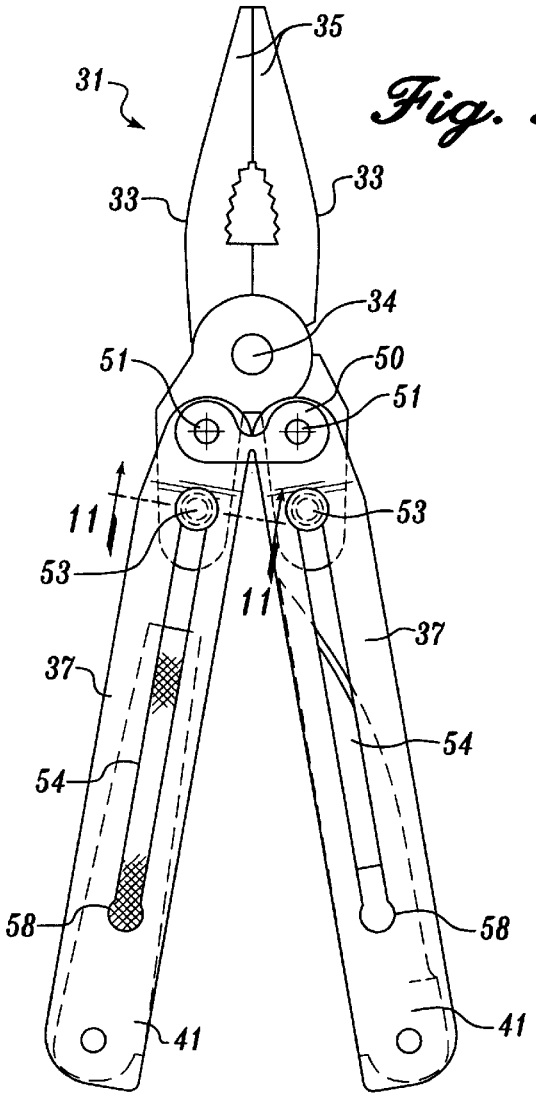
Fig. 9
Fig. 10
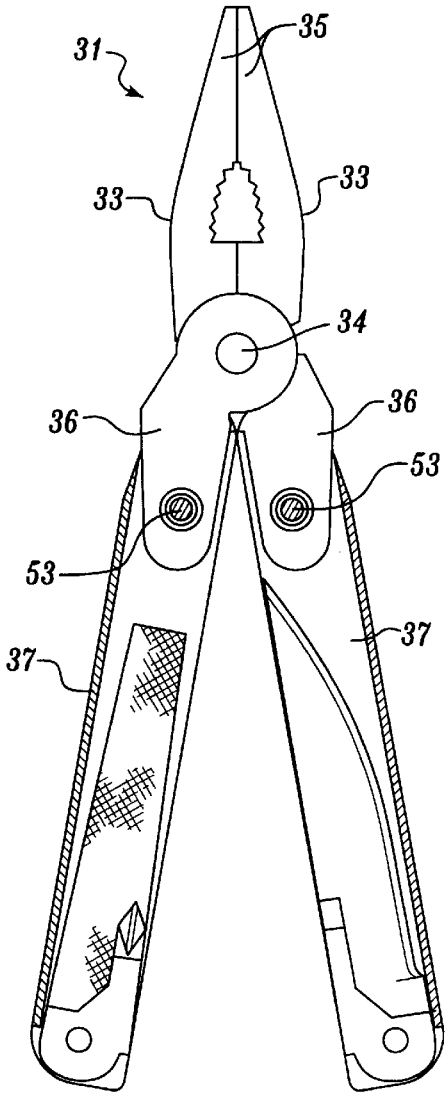
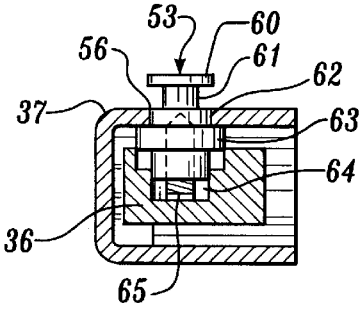
Fig. 11

MULTIPURPOSE TOOL AND COMPONENTS THEREOF

RELATION TO PRIOR APPLICATION

This application is a continuation-in-part of my U.S. patent application Ser. No. 09/157,780, filed on Sep. 21, 1998, now U.S. Pat. No. 6,003,180, which is a continuation of application Ser. No. 08/761,428, filed on Dec. 6, 1996, now U.S. Pat. No. 5,809,599, which is a continuation of application Ser. No. 08/479,469, filed on Jun. 7, 1995, now abandoned, which was a continuation-in-part of application Ser. No. 08/292,578 filed on Aug. 19, 1994, now abandoned, which is a continuation-in-part of my U.S. patent application Ser. No. 08/158,894 filed on Nov. 29, 1993, now abandoned.

BACKGROUND OF THE INVENTION

Leatherman U.S. Pat. No. 4,744,272, issued May 17, 1988, discloses a "Foldable Tool" including pliers jaws having respective tangs or butt portions remote from the cooperating work or grasping end portions of the jaws. The butt portions are pivoted to channel-shaped handles. The pivots for the jaws and handles are parallel. The handles are swingable relative to the jaws for compact nesting of the jaws within the handles. Pocket knife implements can be separately pivoted to the channel-shaped handles.

Other types of compound tools having cooperating jaws swingable relative to handles are disclosed in German Patentschrift 30788, published Aug. 14, 1984, and in the following U.S. patents: Mcloos, U.S. Pat. No. 649,344, issued May 8, 1900; Di Maio, U.S. Pat. No. 1,524,694, issued Feb. 3, 1925; Leatherman patent U.S. Pat. No. 4,238,862, issued Dec. 16, 1980; Leatherman patent U.S. Pat. No. 4,888,869, issued Dec. 26, 1989; and Collins et al., U.S. Pat. No. 5,062,173, issued Nov. 5, 1991.

Yet another compound tool having cooperating pliers jaws swingable relative to handles is disclosed in my U.S. patent application Ser. No. 07/891,990, filed May 27, 1992, and issued on Dec. 7, 1993 as U.S. Pat. No. 5,267,366.

In the tools of most of the patents referred to above, the handles of the tools normally form extensions of the butt portions of the jaws, and the handles usually are longer than the grasping or working end portions of the jaws. In order to achieve a mechanical advantage, the handles must be grasped at their end portions remote from the jaws. Nevertheless, such tools often are formed with handles shorter than the handles of standard tools, for compactness when the jaws are swung or otherwise retracted into the handles. Therefore, the mechanical advantage that can be achieved is limited. Such tools also may have narrow side edges that are difficult or uncomfortable to grasp, and/or swinging implements that do not securely lock in place or are difficult to release, or lack implements for special tasks.

SUMMARY OF THE INVENTION

The present invention preferably is used with a multipurpose tool having cooperating jaw members pivoted together such that working end portions of the jaw members are movable toward and away from each other. The jaw members have tang or butt portions extending opposite the jaw pivot from the working end portions. Such butt portions are, in turn, pivoted to elongated handles for swinging about axes parallel to the axis of the jaw pivot. The handles are channel-shaped and define recesses into which the interconnected jaw members can be swung or retracted so as to be nested in the handles.

More specifically, in the "open" position of the tool, the handles form extensions of the jaw members and have forward ends adjacent thereto and rear ends remote therefrom. The tool can be "closed" by swinging the handles away from each other. The handles are moved relative to the jaws through angles approaching 180° in order to receive the jaw members within the handles.

In one aspect of the present invention, a cover or lid member is connected to each handle. Such member extends over the otherwise open channels for more comfortable grasping of the handles when in their open positions. The cover members can have openings through which the jaw members swing when the handles are moved to the closed positions. The handle covers or lids can be swung or otherwise moved to open the channels for access to implements swingably mounted therein.

In another aspect of the present invention, a convenient and sturdy lock mechanism is provided to retain implements that are swingably mounted in the channels of the handles. Such lock mechanism can include a spring-biased finger received in a corresponding notch of the tang portion of the implement.

In another aspect of the present invention, special implements are provided for mounting in the channels of the handles, including a stud or driver implement for use with standard socket tool components and a specialized scissors implement having one handle pivoted in a channel of the multipurpose tool and another handle pivoted relative to the first handle and spring biased relative thereto.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 9 is a top plan corresponding to FIG. 7, but with parts in different positions, illustrating the open condition of the tool with the handles forming extensions of the jaw members;

FIG. 10 is a top plan corresponding to FIG. 9, but with parts broken away;

FIG. 11 is an enlarged fragmentary section taken along line 11—11 of FIG. 9;

DETAILED DESCRIPTION OF THE PREFERRED EMBODIMENT

The preferred embodiment of the present invention is used with a tool of the type having cooperating jaw members pivoted to opposing handles. The handles are swingable relative to each other and are movable relative to the jaw members for compact nesting of the jaw members in the handles. In addition, the handles can carry a variety of pocketknife implements each of which can be swung relative to its handle between a projected working position and a closed position retracted into the handle.

Figure 1:
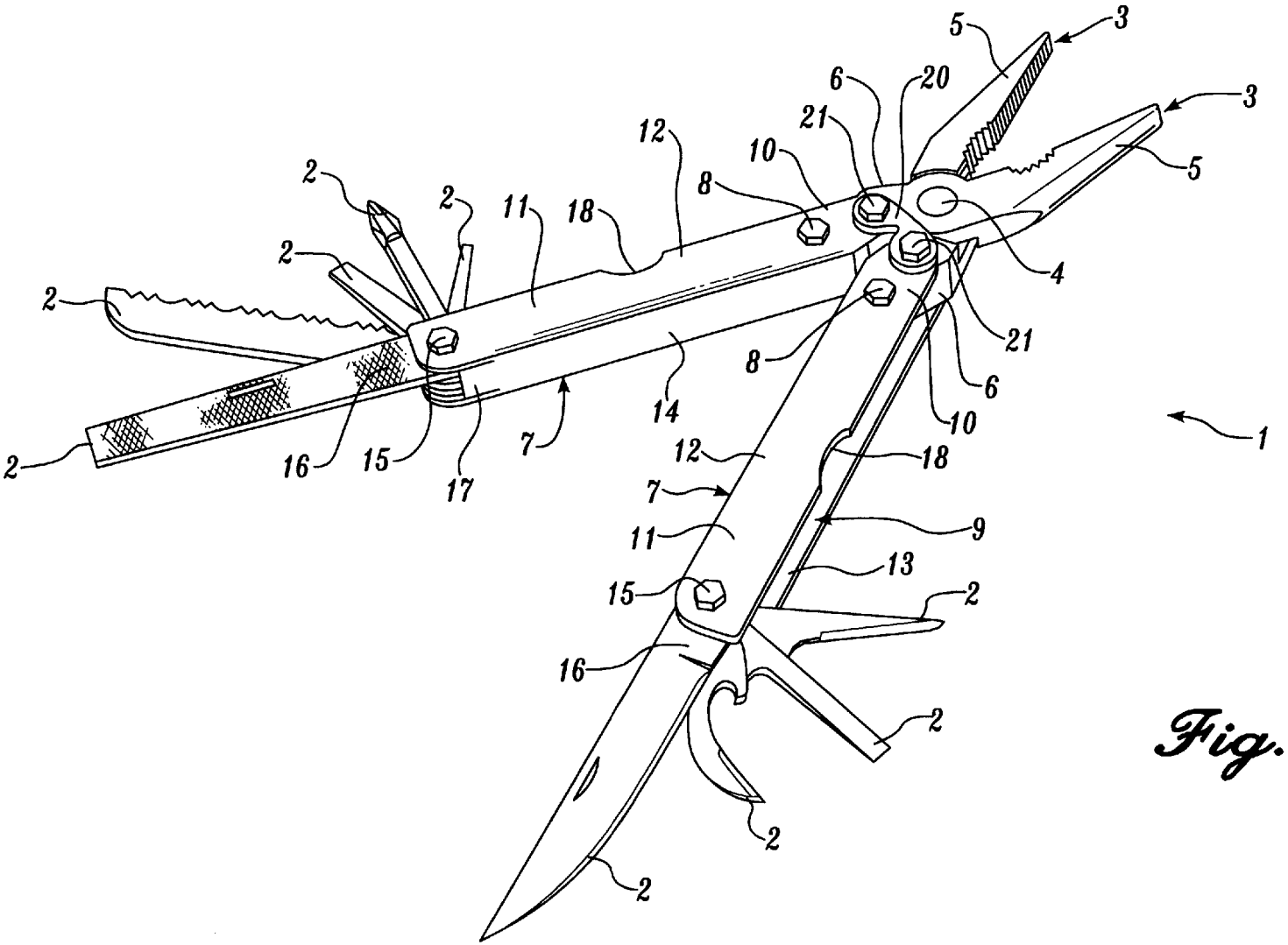
FIG. 1 is a top perspective of a compound pliers tool with linked handles of the general type with which the present invention can be used, such tool including cooperating jaw members pivotally connected to a pair of handles.

FIG. 1 illustrates such a compound pliers tool 1 with each of the pocketknife implements 2 projected or partially projected. Such tool 1 includes opposing jaw members 3 connected by a pivot 4. The working end portions 5 of the jaw members are swingable toward and away from each other about the axis of the pivot. In this embodiment, the jaw members are pliers jaws.

The butt portions 6 of the jaws extend from the pivot 4 in a direction opposite the direction that the working end portions 5 project from the pivot. The butt portions are connected to handles 7 by pivots 8 that extend parallel to the jaw pivot 4. Each handle defines a channel 9 which opens outward, away from the channel of the other handle when the tool is in the open condition illustrated in FIG. 1. In such open condition of the tool, the handles 7 appear to form extensions of the jaw members 3.

Each handle 7 has a leading or forward end portion 10 projecting from its pivot 8 generally toward the opposing jaw members 3 and a trailing or rear end portion 11 projecting from its pivot generally away from the jaw members. In addition, each handle includes a top plate 12, a bottom plate 13, and an inner upright web 14 extending between such plates. The pocketknife implements 2 are swingable between retracted positions fitted between the handle top and bottom plates 12 and 13 and working positions projected from the handles. More specifically, the pocketknife implements have root portions 16 swingably connected to the rear end portions 11 of the handles by upright pivots 15. Pivots 15 are parallel to the jaw pivot 4 and the handle pivots 8. The root portion 16 of each implement 2 is engaged by a leaf spring 17 formed as an extension of the vertical web 14 connecting the corresponding top and bottom plates 12 and 13. The leaf spring also can limit the degree to which an implement can be swung to its open position. One or more of the top and bottom plates 12 and 13 can have a finger notch 18 for access to edge portions of the implements when they are retracted.

Handles 7 are swingable relative to the jaw members 3 about the axes of the pivots 8. The leading end portions 10 of the handles are interconnected by a short link 20 extending over the top plates 12 of the handles. Link 20 has its opposite ends connected to the front end portions 10 of the handles by short pivot pins 21. In the open condition of the tool 1 illustrated in FIG. 1, link 20 is positioned between the jaw pivot 4 and the handle pivots 8.

Figure 2:
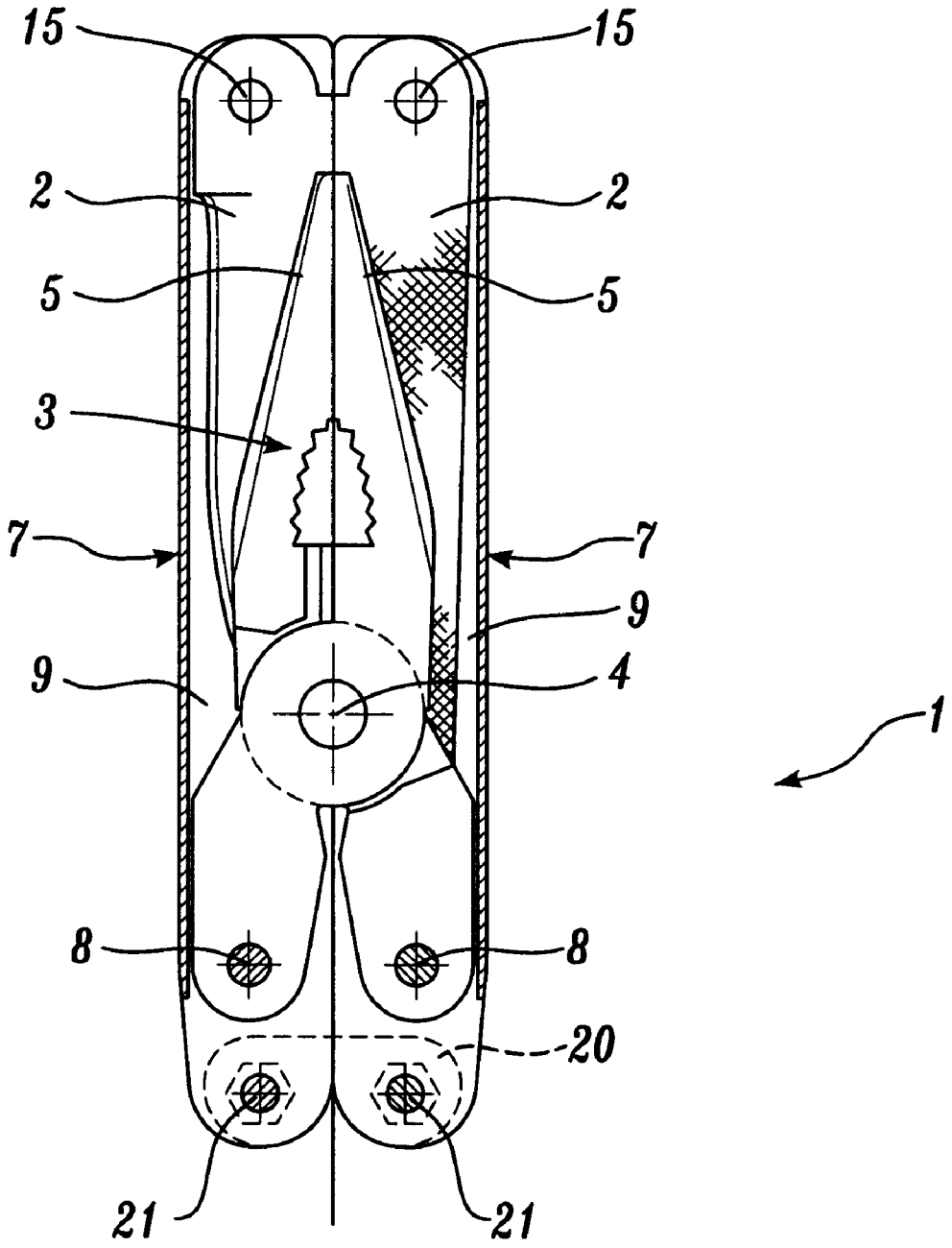
FIG. 2 is a top plan of the tool of FIG. 1 with parts broken away, illustrating the closed condition of the tool with the jaw members nested in the handles.

Each handle 7 is freely swingable through an angle approaching 180° about the axis of its pivot 8 from the open condition of the tool illustrated in FIG. 1 to the closed condition shown in FIG. 2. As seen in FIG. 2, in such closed condition the jaw members 3 are received in the channels 9 of the handles between the handle top and bottom plates. The pocketknife implements 2 are arranged in the channels so that they do not interfere with nesting of the jaw members. Preferably, in the closed condition of the tool illustrated in FIG. 2, the inner edges of the handles are closely adjacent, as are the facing surfaces of the working end portions 5 of the jaw members.

Figure 3:
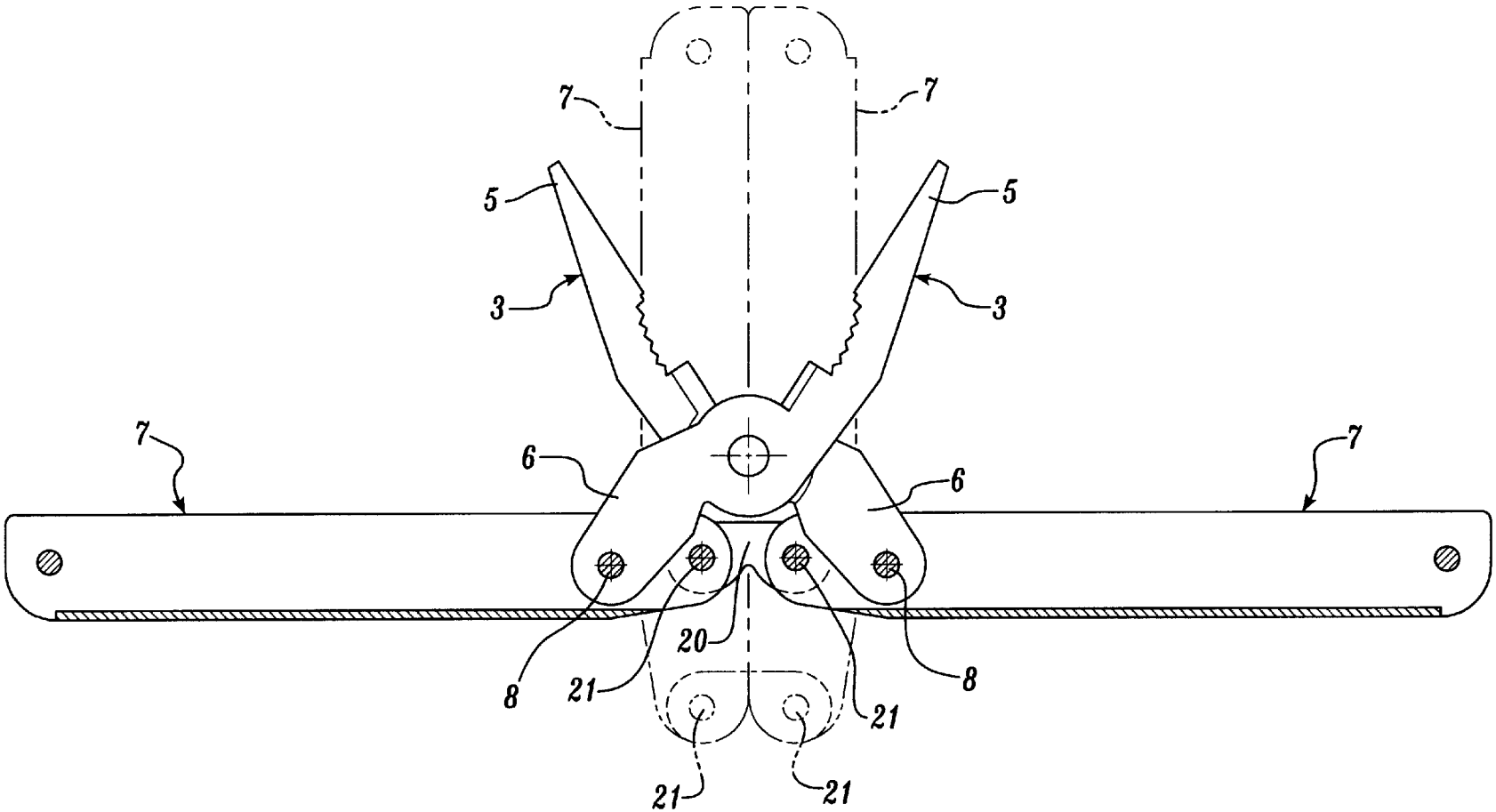
FIG. 3 is a top plan corresponding to FIG. 2, but with parts in different positions, illustrating an intermediate condition of the tool with the jaw members and the handles spread apart.
Figure 4:
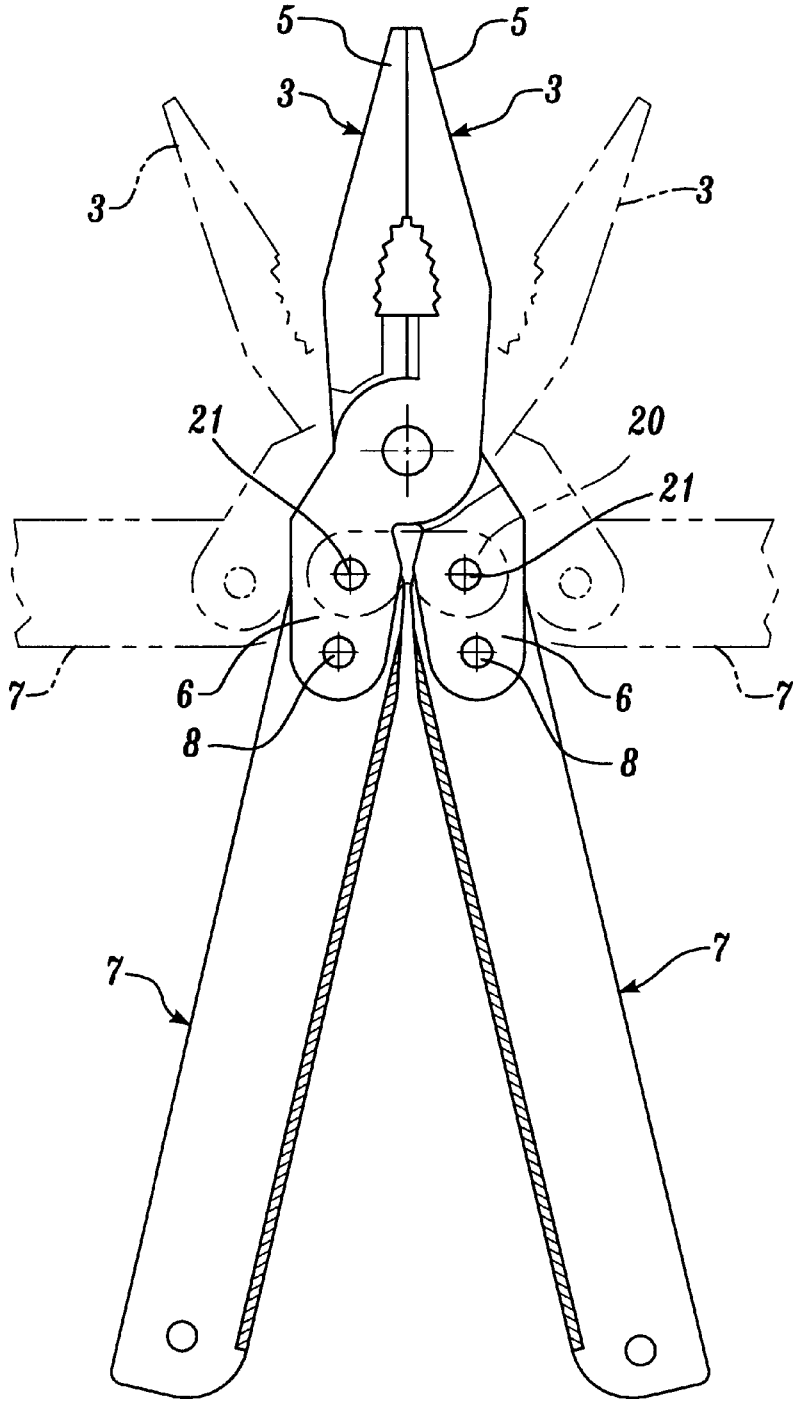
FIG. 4 is a top plan corresponding to FIGS. 2 and 3, with parts in different positions, illustrating the open condition of the tool with the handles forming extensions of the jaw members.

FIGS. 3 and 4 illustrate the relative positions of the jaws 3, link 20 and handles 7 as the tool is opened. With reference to FIG. 3, as the handles 7 are swung away from each other from the closed position illustrated in broken lines, the handle pivots 8 travel in circular arcs centered about the associated link pivots 21. When each handle has been swung through an angle of 90° to the solid line position illustrated in FIG. 3, pivots 8, which control the positions of the jaw butt portions 6, are at their maximum distance from each other so that the working end portions 5 of the jaws 3 are at their most spread apart positions. With reference to FIG. 4, as the handles 7 continue to be swung away from the jaws 3, the handle pivots 8 and, consequently, jaw portions 5 are moved toward each other. The result is that the working end portions 5 of the jaws 3 are closed. Preferably, in the fully "open" condition of the tool illustrated in solid lines in FIG. 4, the handles still diverge from each other at a small acute angle even though the working end portions 5 of the jaws are in engagement, so that the strong grasping force can be continued to be supplied to the jaws.

In a tool of the type described, i.e., having handles linked as described above, the mechanical advantage achieved by swinging the handles no longer is a function of only the relative length of the handles as compared to the length of the working end portions of the jaws. Rather, the handles are swung through relatively large angles while the jaws are swung through a smaller angle. For example, with reference to FIG. 3, in the illustrated embodiment when each handle is swung through an angle of 90° from the broken line position of FIG. 3 to the solid line portion, the jaws are swung through an angle of less than 45°. The actual mechanical advantage achieved is a function of the location of the handle pivots 8 along the circular arc centered about the corresponding link pivot 21. In the solid line position shown in FIG. 3, the handle pivots would move toward other only slightly for a given angle of swing of the handles, and a large mechanical advantage is achieved. As the handles approach the solid line position shown in FIG. 4, the handle pivots 8 move toward or away from each other to a greater degree for the same swing angle, although still much less than the angle through which the jaws are swung. The length of the handles, the relative positions of the jaw pivots and the link pivots, the length of the jaw butt portions, and the length of the jaw working end portions all can be selected to achieve a desired mechanical advantage depending on the particular application.

Figure 5:
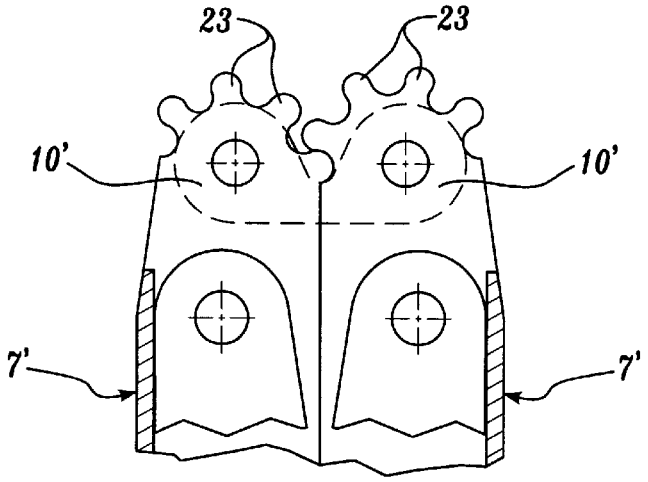
FIG. 5 is an enlarged fragmentary top plan of a modified compound pliers tools with linked handles in accordance with the present invention.
Figure 6:
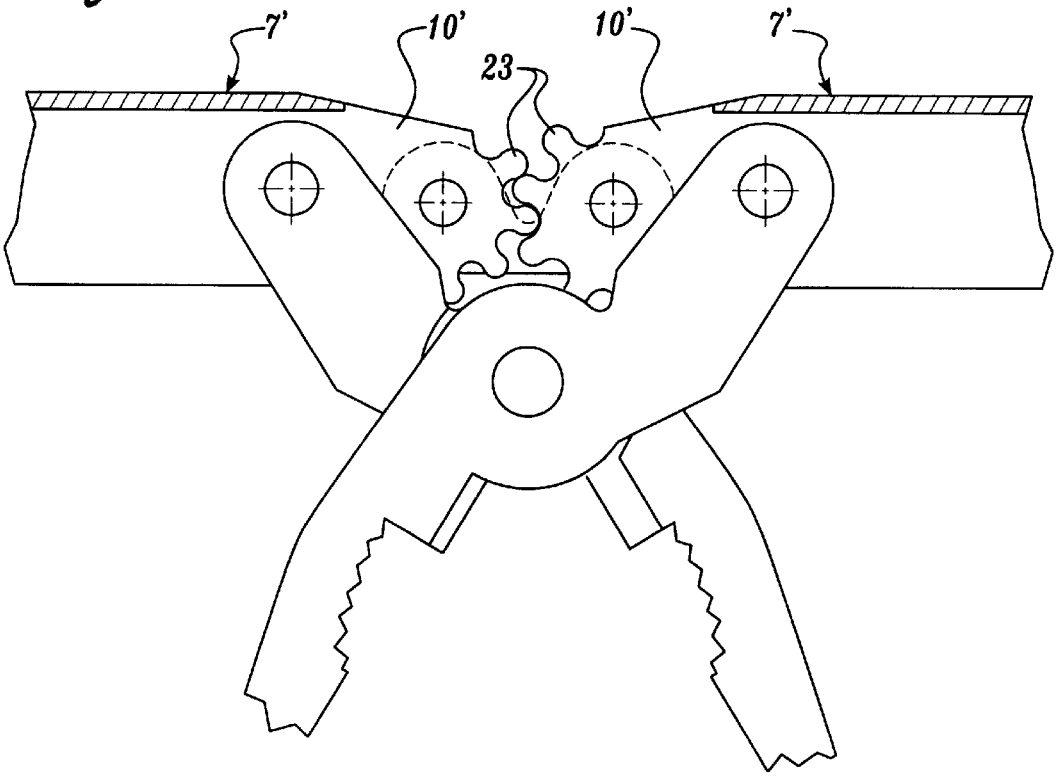
FIG. 6 is an enlarged fragmentary top plan of the modified tool of FIG. 5 with parts in different positions.

FIGS. 5 and 6 illustrate a modification for the tool with linked handles. In the modified form, the leading end portions 10' of the handle top and/or bottom plates have rounded gear teeth or fingers 23 designed to interdigitate as the handles 7' are swung relative to each other. In that case, the handles always will swing together through the same angle. FIG. 5 illustrates the closed position of the modified tool whereas FIG. 6 illustrates the partially open position. In all other respects, the modified form shown in FIGS. 5 and 6 is identical to the form shown in FIGS. 1–4.

Figure 7:
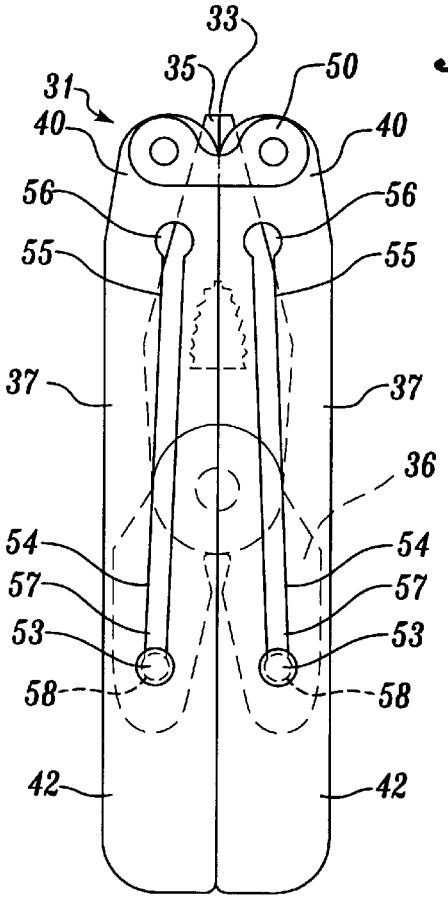
FIG. 7 is a top plan of another modified compound pliers tool with linked handles, illustrating the closed condition of the tool with the jaw members slidably retracted into the handles.
Figure 8:
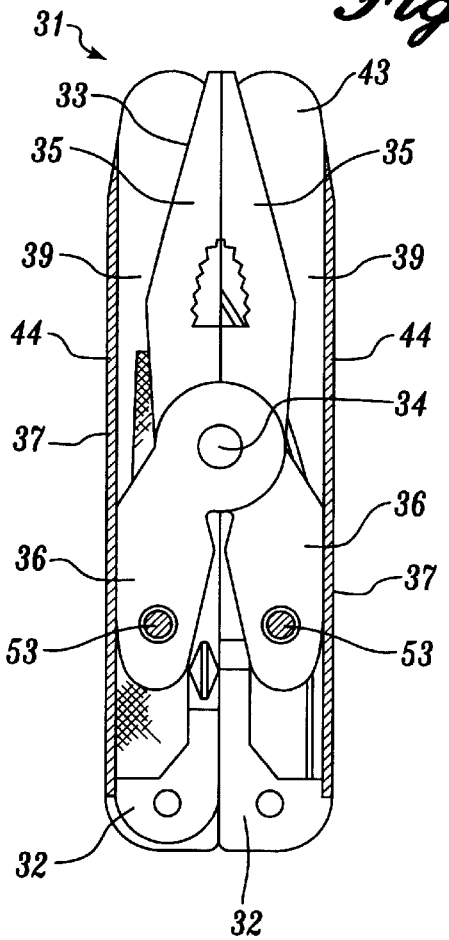
FIG. 8 is a top plan corresponding to FIG. 7, but with parts broken away.

In the modified tool 31 illustrated in FIGS. 7–14, the jaw members 33 are slidably retractable for partial containment of the jaw members in the handles 37 in the closed condition shown in FIGS. 7 and 8. In such closed condition the jaw members 33 are received in the channels 39 of the handles 37 between the top and bottom plates 42 and 43. The pocketknife implements 32 are arranged in the channels 39 so that they do not interfere with retracting of the jaw members 33.

The butt portions 36 of the jaw members are connected to the handles 37 by fasteners 53 that extend parallel to the jaw pivot 34. The top plate 42 of each handle has a linear slot 54 which extends along the axis of the handle. The forward end portion 55 of the slot includes an aperture 56 for receiving the fastener 53 in the open position. Similarly, the rear end portion 57 of the slot 54 can include a second aperture 58 for receiving the fastener 53 in the closed position. In addition, each channel 39 opens inward, toward the channel of the other handle and away from the outer upright web 44 extending between the top and bottom plates of the handle.

The fasteners 53, and hence jaw members 33, are slidable relative to the handles along the slot 54. A short link 50 extends over the top plates 42 of the handles and connects the leading end portions 40 of the handles. In the closed position shown in FIG. 7, the working end portions 35 of the jaw members protrude partially from the channels of the handles.

FIGS. 9 and 10 illustrate the relative positions of the jaw members 33, link 50 and handles 37 when the tool is in the open position. Preferably, the handles 37 still diverge from each other at a small acute angle even though the working end portions 35 of the jaw members are in engagement, so that a strong grasping force can be continued to be supplied. With reference to FIG. 9, as the fasteners 53 are slidably moved along the slot 54 from the open position to the closed position, the rear end portions 41 of the handles converge because the longitudinal slots 54 extend at small angles relative to the longitudinal centerlines of the handles. In the preferred embodiment, the angle of each slot is 15° from the longitudinal centerline of the corresponding handle.

FIG. 11 illustrates the fastener 53 for slidably coupling the butt portions 36 of the jaw members to the handles 37. The fastener includes a top head 60, a narrower stepped shank 61, 62, and a broader foot 63. The foot 63, which also can be stepped, fits in a blind bore 64 that opens through the top of the jaw member butt portion 36. The head 60 of the fastener lies outside the handle channel and is substantially circular in shape with a diameter at least slightly larger than the diameter of apertures 56 and 58. The top portion 61 of the stepped shank is substantially cylindrical with a diameter slightly less than the width of the central portion of the slot 54. The lower portion 62 of the shank is substantially cylindrical with a diameter slightly less than the diameters of the apertures 56 and 58.

A compression spring 65 is fitted between the base of bore 64 and the underside of the fastener foot 63 to bias the fastener upward. When registered with an aperture 56 or 58, the larger portion 62 of the fastener shank fits in the aperture. This position of the fastener prevents the jaw members from sliding with respect to the handles when the jaws are in the fully extended position shown in FIGS. 12 and 13. Nevertheless, the interconnection does not inhibit swinging of the handles relative to the jaw members about the upright axis of the fastener.

Figure 13:
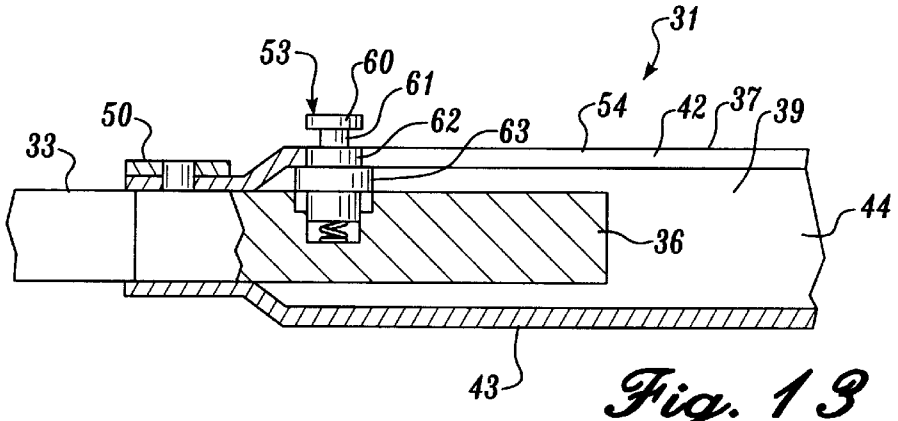
FIG. 13 is an enlarged fragmentary side elevation of the modified tool of FIG. 7, with parts broken away.
Figure 14:
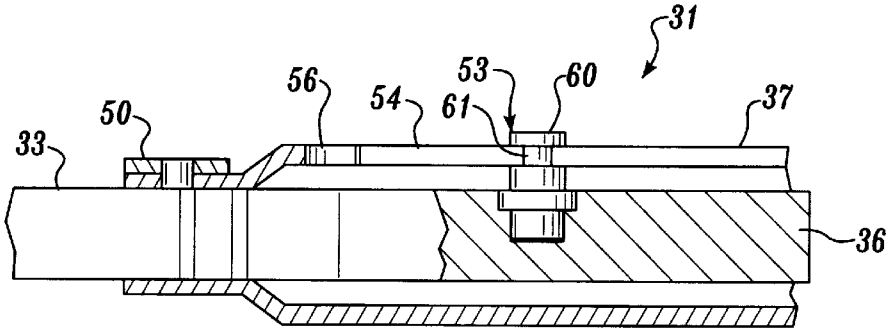
FIG. 14 is an enlarged fragmentary side elevation of the modified tool of FIG. 7, corresponding to FIG. 12, but with parts in different positions.

With reference to FIGS. 13 and 14, the jaw members can be moved from the fully extended position to the retracted position by applying a slight downward force to the head 60 of the fastener to overcome the spring bias, and then slidably moving the fastener toward the rear end of the handle along the longitudinal slot 54. When the jaws are not in the fully extended or fully retracted position, the fastener shank portion 61 rides in the longitudinal slot 54 as seen in FIG. 14. When the jaw members are fully retracted, the fastener pops up to the position shown in FIG. 11 so that the jaw members are held retracted until the fastener head is pushed down to allow the sliding movement of the jaw members in the handles.

Figure 12:
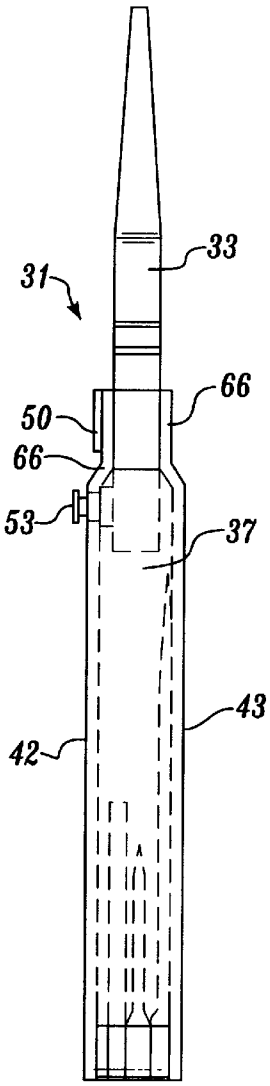
FIG. 12 is a side elevation of the modified tool of FIG. 7.

With reference to FIG. 12, the leading portions 66 of the handle top and bottom plates 42 and 43 converge to receive the jaw members 33 between them when the tool is "open." This provides a sturdier, more secure interconnection of the handles with the jaw members when the tool is used.

With reference to FIGS. 9 and 10, the geometry of the tool 31 when in the open condition is identical to the geometry of the first described embodiment, that is, the relative positions of the jaw pivot 34, link pivots 51, and handle pivots (fasteners 53) are the same. Consequently, the same mechanical advantage is achieved. The jaw members move through a smaller angle than the handles. In all other respects, the modified form of the invention shown in FIGS. 7–14 is identical to the form shown in FIGS. 1–4.

Figure 15:
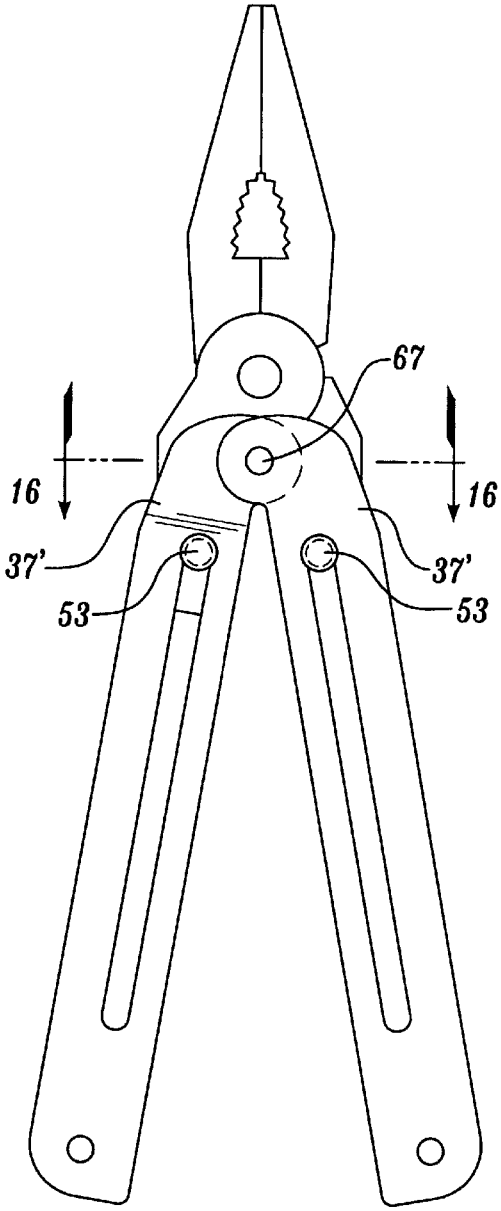
FIG. 15 is a top plan of another modified compound pliers tool with slidably retractable jaws, illustrating an alternative means for linking the handles.
Figure 16:
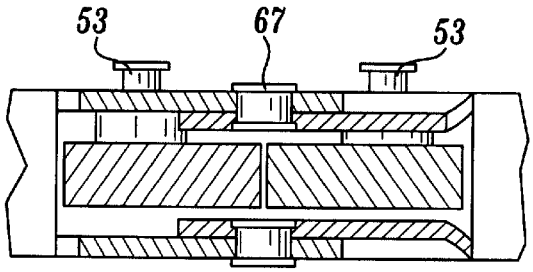
FIG. 16 is an enlarged fragmentary section taken along line 16—16 of FIG. 15.

FIGS. 15 and 16 illustrate a modification for the tool illustrated in FIGS. 7–14. In the modified form, the leading end portions of the handles 37' are curved inward and are interconnected by a pivot 67 that extends parallel to the jaw pivot 34. In the open condition of the tool illustrated in FIG.

15, pivot 67 is positioned between the jaw pivot 34 and the handle fasteners 53. In all other respects, the modified form of the invention shown in FIGS. 15 and 16 is identical to the form shown in FIGS. 7–14.

Figure 17:
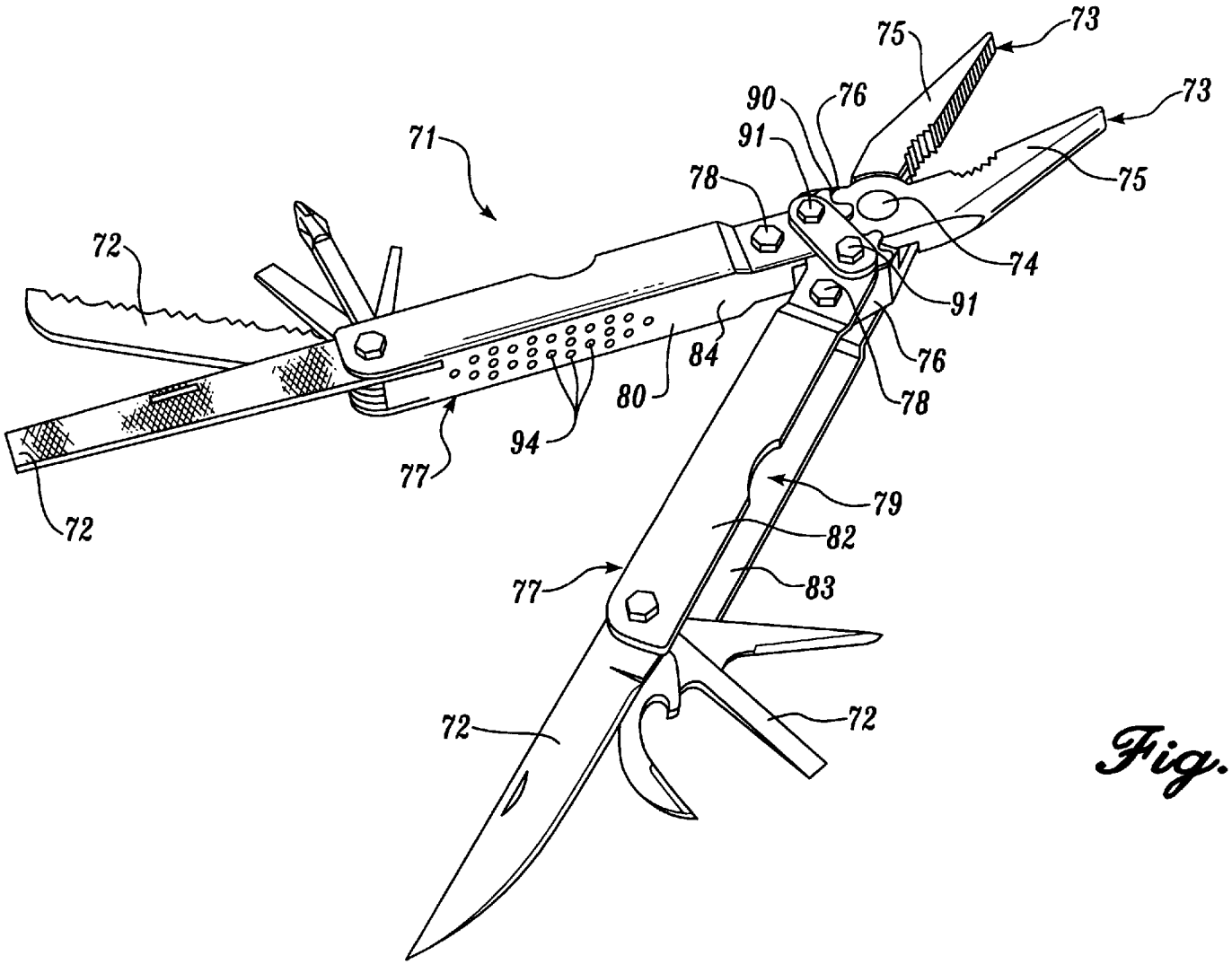
FIG. 17 is a top perspective of another modified compound pliers tool with linked handles of the general type with which the present invention can be used.
Figure 18:
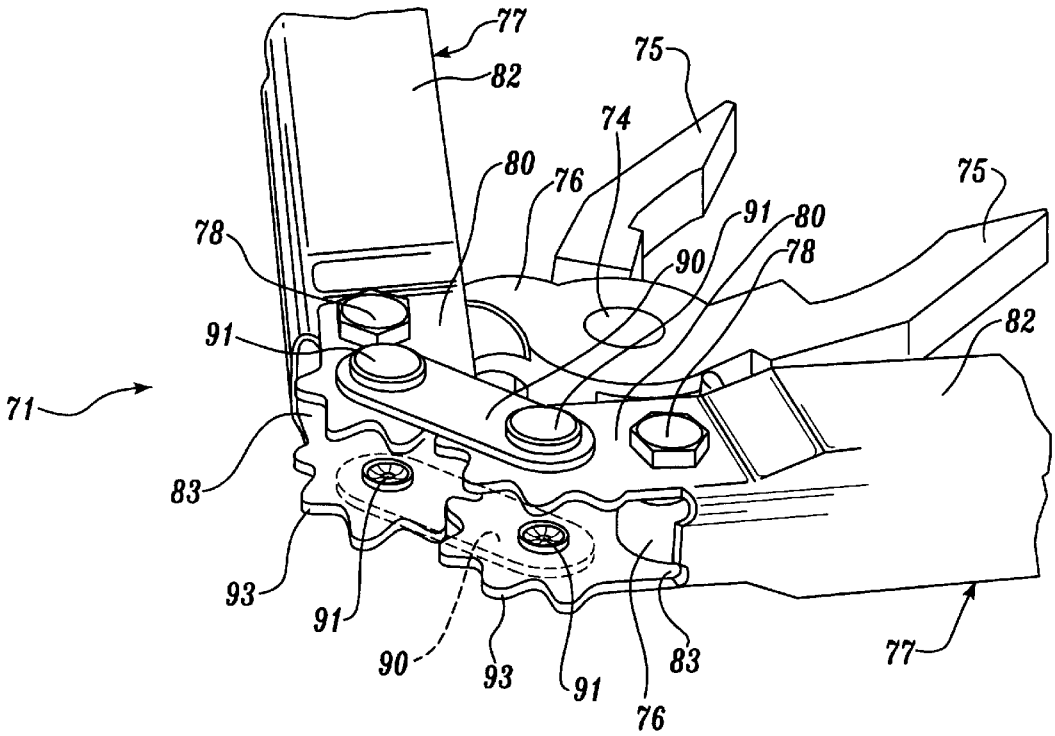
FIG. 18 is an enlarged fragmentary top perspective of the tool of FIG. 17, with parts in different positions.
Figure 19:
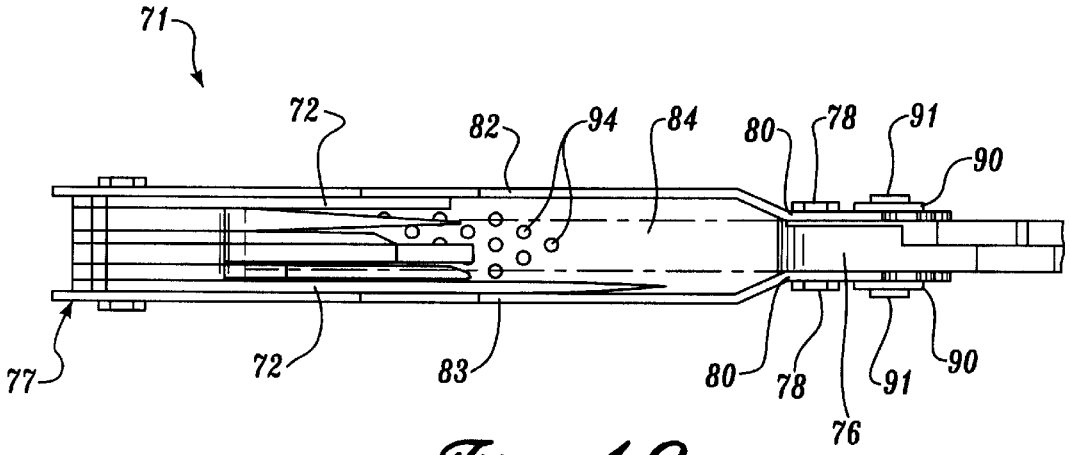
FIG. 19 is a side elevation of the tool of FIG. 17, with parts in different positions and parts broken away.

With reference to FIGS. 17, 18 and 19, another embodiment of a tool 71 of the type with which the present invention is concerned has many of the features of the embodiments previously described. FIG. 17 shows each of the pocket knife implements 72 projected or partially projected. Tool 71 includes opposing jaw members 73 connected by a pivot 74. The working end portions 75 of the jaw members are swingable toward and away from each other about the axis of the pivot. The butt portions 76 of the jaw members extend from the pivot 74 in a direction opposite the direction that the working end portions 75 project from the pivot. The butt portions are connected to handles 77 by pivots 78 that extend parallel to the jaw pivot 74. Each handle defines a channel 79 which opens outward, away from the channel of the other handle, when the tool is in the open condition illustrated in FIG. 17. In such open condition of the tool, the handles 77 appear to form extensions of the jaw members 73.

Each handle 77 has a leading or forward end portion 80 projecting from its pivot 78 generally toward the opposing jaw members 73, and a trailing or rear end portion projecting from its pivot generally away from the jaw members. In addition, each handle includes a top plate 82, a bottom plate 83, and an inner upright web 84 extending between such plates. The pocket knife implements 72 are swingable between retracted positions fitted between the handle top and bottom plates 82 and 83 and working positions projected from the handles. The connection of the pocket knife implements 72 to the rear end portions of the handles is the same as for the embodiment of the present invention shown in FIG. 1.

Handles 77 are swingable relative to the jaw members 73 about the axes of the pivots 78. The leading end portions 80 of the handles are interconnected by a short link 90 extending over the top plates 82 of the handles. The opposite end portions of the top link are connected to the top plates by short pivots 91. As seen in FIGS. 18 and 19, an identical link 90 extends below the handle bottom plates 83 between short bottom pivots 91. Preferably, the leading end portions 80 of both the top and bottom plates 82 and 83 are formed with rounded gear teeth 93 designed to interdigitate as the handles 77 are swung relative to each other. Thus, the handles always will swing together through the same angle. The jaw member butt portions 76 fit between the top and bottom plates 82 and 83, i.e., within the channels of the handles, as compared to the links 90 which are positioned outside the channels at the top and bottom.

As best seen in FIGS. 18 and 19, the leading end portions of the handle top and bottom plates 82 and 83 converge in the areas of the pivots 78 and 91. The jaw member butt portions 76 are closely embraced at such leading end portions. The rear portions of the channels defined between the top and bottom plates 82 and 83 are substantially wider, both at the top and bottom of the tool. This provides room adjacent to each top plate and each bottom plate for a longer, wider pocket knife implement to fit above or below the jaw members when the tool is closed. Shorter and/or narrow implements can be mounted between the longer implements, i.e., in registration with the jaw members, for fitting alongside the jaw members when the tool is closed.

Preferably, the upright webs 84 of the handles have scattered holes 94 to allow water that otherwise would collect in the channels to pass out, and to permit ventilation and evaporation.

The geometry of the preferred tool 71 is identical to the geometry of the first-described embodiment, that is, the relative positions of the center jaw pivot, link pivots, and handle pivots are the same. Consequently, the same mechanical advantage is achieved. The jaw members move through a smaller angle than the handles; and, in the closed position, the working end portions 75 of the jaw members abut, with the jaw members fully nested within the handles, and with the inner edges of the handles in engagement, as illustrated for the first-described embodiment of the invention in FIG. 2.

With the handles 77 swung to their open positions, the working end portions of the jaw members engage when the handles still are at a small angle relative to each other, so that a strong grasping force can continue to be applied. Alternatively, the grasping action of the jaw members can be obtained when the handles are swung past their open-most positions toward their closed positions, i.e., the approximate positions shown in FIG. 18. In that case, one handle can rest on a supporting surface while the other handle is forced toward the supporting surface to achieve a strong grasp. The long, straight, flat webs of the handles help to steady the tool in this position for convenience and safety.

FIGS. 20–29 illustrate improvements in accordance with the present invention for a tool of the type shown in FIGS. 17–19. There are sufficient similarities between tool 71' of FIG. 20 (additional details of which are shown in FIGS. 21–28) that like reference numbers are used for like parts. More specifically, tool 71' has the opposing jaw members 73 connected by a pivot 74. Working end portions 75 of the jaw members are swingable toward and away from each other about the axis of pivot 74. The butt portions 76 of the jaw members extend from the pivot 74 in a direction opposite the direction that the working end portions 75 project from the pivot. The butt portions are connected to handles 77', identical to the handles previously described except as noted below. Each handle has a channel 79 formed between top and bottom plates 82, 83. The channels of the handles open outward, away from each other, when the tool is in the open condition illustrated in FIG. 20.

Each handle has a leading or forward end portion 80 projecting from its pivot 78 generally toward the opposing jaw members 73, and a trailing or rear end portion projecting from its pivot generally away from the jaw members. The pocket knife implements are swingable between retracted positions fitted between the handle top and bottom plates 82, 83 and working positions projected from the handles. For example, a special scissors implement 100 and stud or driver implement 101 are shown in the projected positions in FIG. 20. These implements are described in greater detail below.

The leading end portions 80 of the handles are interconnected by links 90, identical to the links described previously with reference to the embodiment of FIGS. 17–19, and opening and closing of the tool is as described previously, with the same mechanical advantage being achieved.

Figure 20:
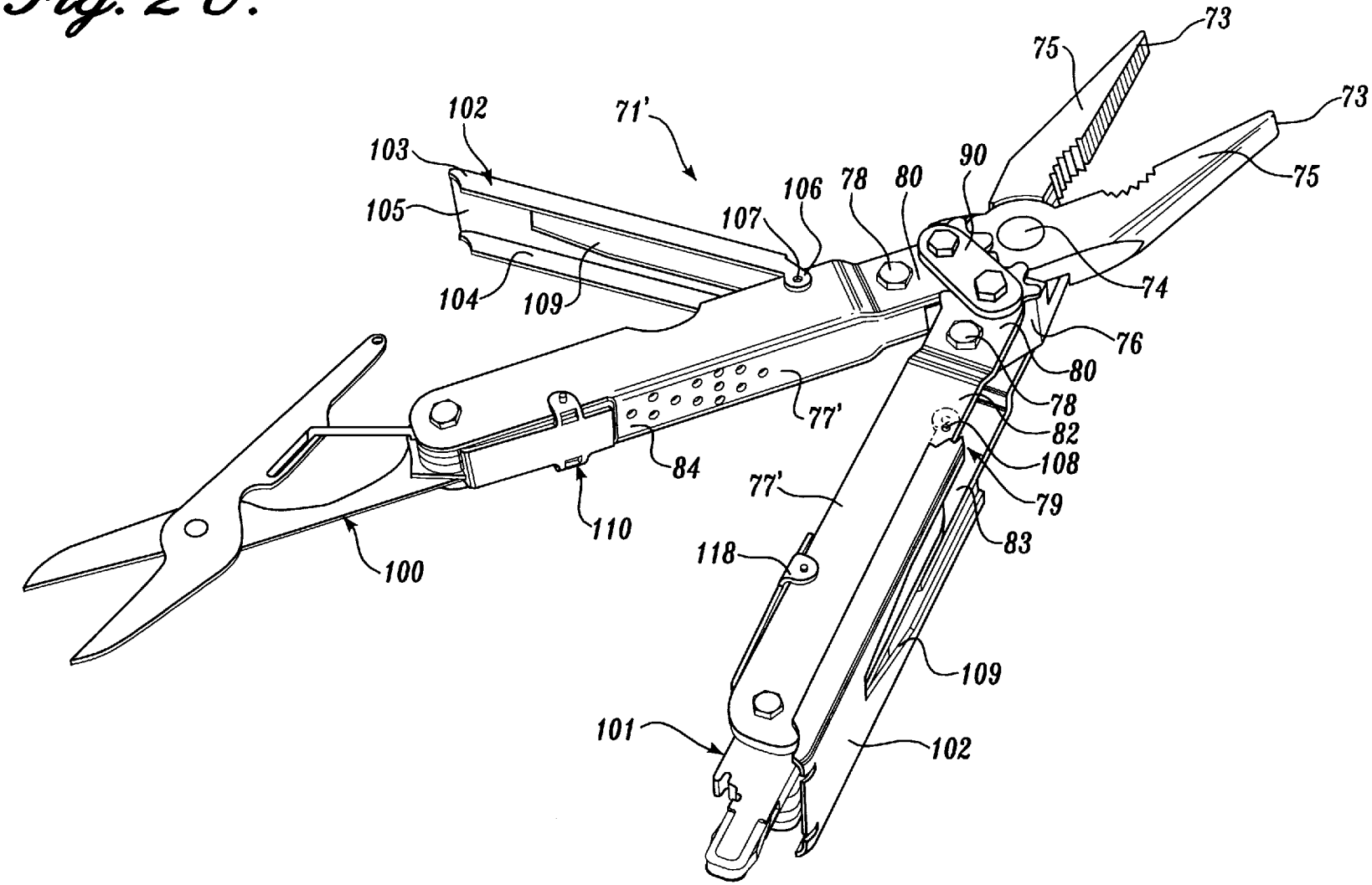
FIG. 20 is a top perspective of a multipurpose tool having component parts in accordance with the present invention.

With reference to FIG. 19, it will be noted that in the embodiment of FIGS. 17–19, the pliers are operated by grasping the open sides of the handles 77, which have narrow edges facing outward when the tool is in the open position. This may be uncomfortable if substantial force is applied by hand. In the embodiment of FIG. 20, a cover or lid member 102 is provided for each of the handles. Each handle cover is of generally U-cross section with short top and bottom lips 103 and 104 to nest closely over the top and bottom plates 82 and 83 of the handles. A wide web 105 extends between the top and bottom plates to bridge between the edges of the handle plates 82, 83 which otherwise would be exposed. At corresponding ends of the handle covers 102, short tabs 106 are angled inward for swingably securing the covers 102 to the tool handles 77'. A simple interconnection can be made by providing pressed projections 107 that mate with holes or depressions 108 of the handles. With a handle cover swung open, such as the cover 102 farthest from the viewer in FIG. 20, the user has access to any pocket knife implements mounted within the channel of the corresponding handle 77'. For operation of the pliers, both covers are closed, to the condition illustrated for the cover 102 closest to the viewer in FIG. 20. This provides a wider, more comfortable area for grasping by the user than if the covers were deleted. In order to move the tool from its open condition illustrated in FIG. 20 to the closed condition in which the jaw members 73 are nested in the handles, preferably the handle covers are provided with openings 109 that are contoured to the profile shape of the jaw members such that the jaw members may pass through the openings and into the handles 77' as the tool is closed.

Figure 21:
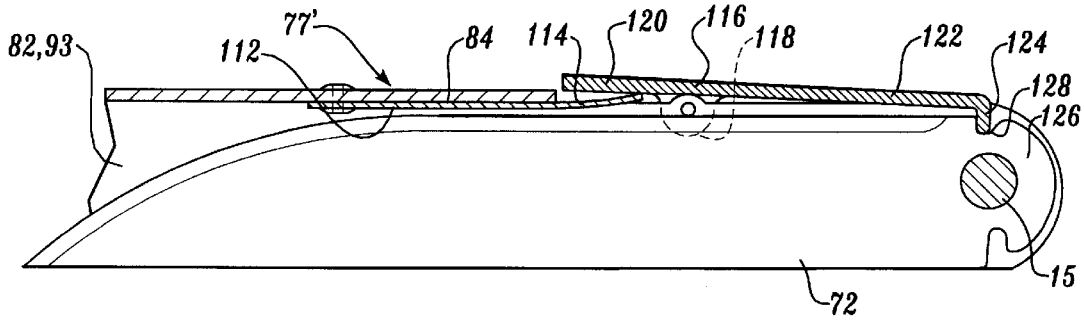
FIG. 21 is an enlarged fragmentary side elevation of an end portion of one of the handles of the tool of FIG. 20 with parts broken away to illustrate a blade lock in accordance with the present invention.
Figure 22:
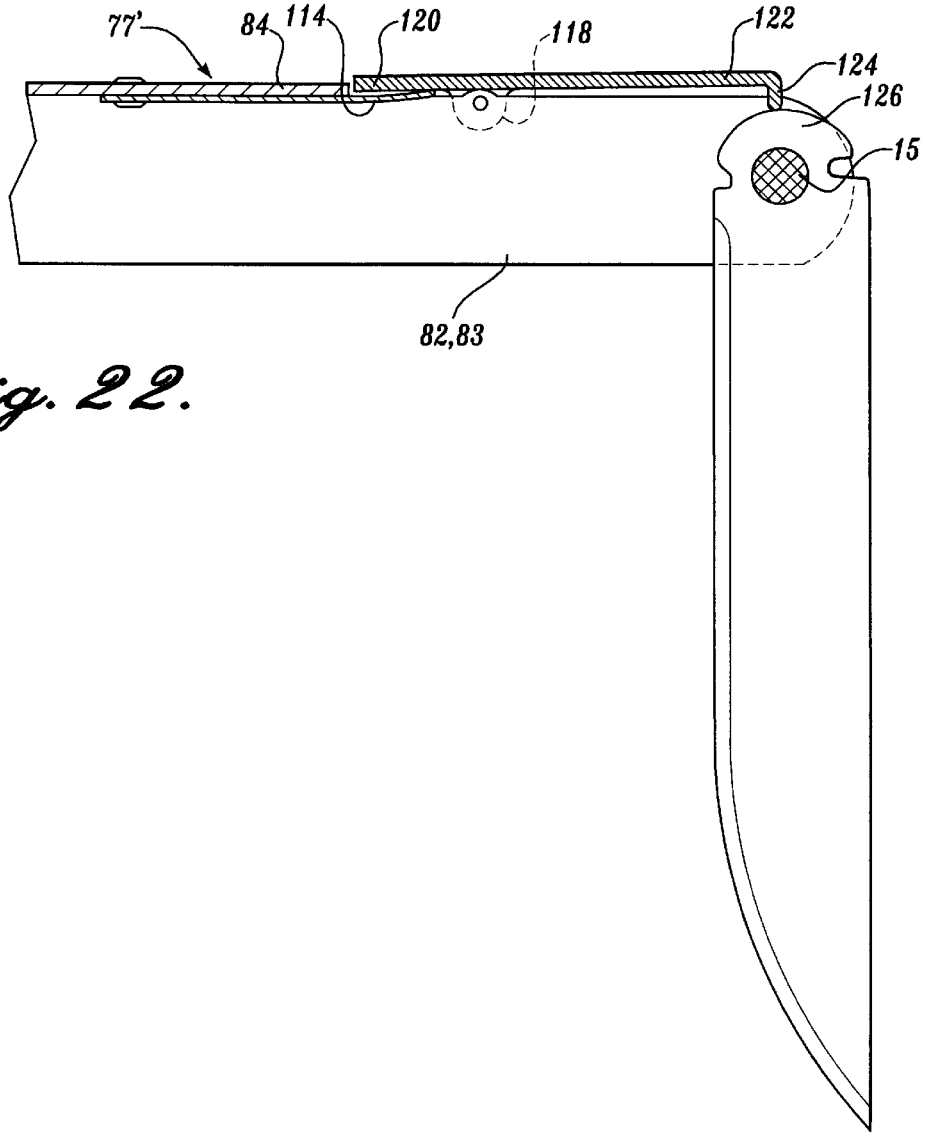
FIGS. 22 and 23 are enlarged fragmentary side elevations corresponding to FIG. 21 but with parts in different positions.
Figure 23:
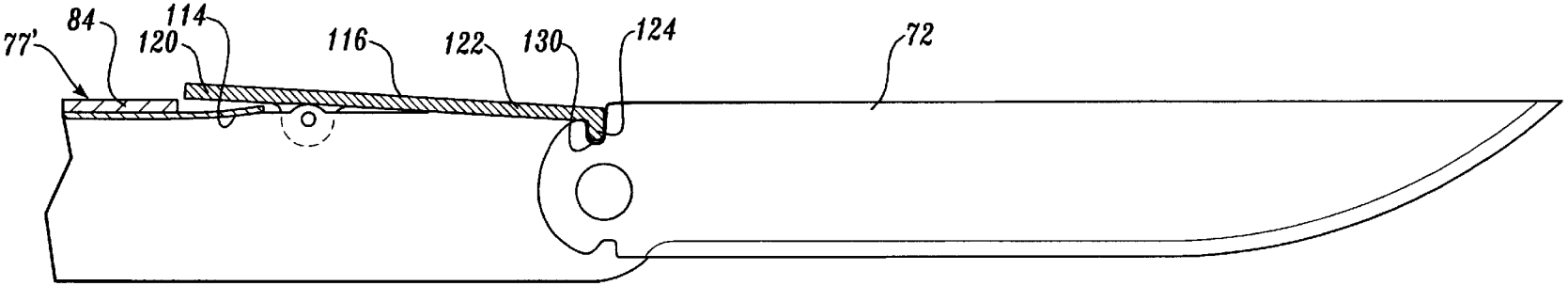

Another improvement of the tool 71' of FIG. 20 is an implement lock 110, shown in greater detail in FIGS. 21–23. The handle web 84 is cut away adjacent to the end of the handle to which the pocket knife implements 72 are pivoted by the pivot pin 15. A short leaf spring 112 has one end riveted to the inside surface of the web 84 and a far or free end 114 projecting beyond the cutout portion of the web and curved outward. A lock lever 116 has bent side tabs 118 pivotally securing the lock lever to the corresponding handle 77'. The center portion of the lock lever 116 is of a width to fit between the top and bottom plates 82, 83 of the handle. The resilient, outwardly bent portion 114 of the leaf spring engages against an end portion 120 of the lock lever and tends to bias such end portion outward, such that the other end portion 122 of the lock lever, adjacent to the end of handle 77' remote from the jaw members, is biased inward. End portion 122 has a lock finger 124 extending essentially perpendicularly inward into the channel area between the top and bottom plates of the handle.

The inner end of finger 124 normally rides along the periphery of the butt or tang portion 126 of the implement 72. As seen in FIG. 21, with the implement in the closed position, retracted into the channel of the handle, the finger 124 can fit in a contoured notch or recess 128 of the tang, such that the implement is biased to the closed position but, due to the angle of the contoured recess 128, is not positively held against opening movement by swinging the working end of the implement counterclockwise as viewed in FIG. 21. As seen in FIG. 22, this swinging has the effect of forcing the finger 124 of the lock lever 116 outward, against the biasing force of the leaf spring 114. When the implement 72 reaches the fully opened position, shown in FIG. 23, finger 124 fits into a deeper and sharper notchor slot 130 in the tang portion of the implement. The flat, essentially radially extending sides of the slot interfit closely with the sides of the finger 124 so as to prevent substantial movement of the implement 72 in either direction. However, the implement can be released for rotation back to its closed position by pressing on the end portion 120 of the lock lever 116, essentially directly above the biasing, free end 114 of the leaf spring, to lift the finger 124 from slot 130 and thereby permit the implement 72 to be swung back through the position of FIG. 22 to the closed position of FIG. 21.

The special scissors implement 100 shown in the open condition in FIG. 20, is illustrated in greater detail in FIGS. 24–27. Such implement includes cooperating scissor blades 140 connected by a pivot 142 for the cooperative cutting motion of the working end portions of the scissors achieved by manipulation of the handles 146, 148 which extend in the opposite direction from pivot 142. The end 150 of handle 146 opposite its working end portion has a contoured tang similar to the tang of implement 72 described above with reference to FIGS. 21–23. Such tang is pivoted to the associated handle 77' by the same pin 15 as other implements fitted in that channel. The scissors implement 100 includes a separate spacer and cam plate 154 with a lost motion arcuate slot 156 receiving a tab 158 projecting from scissors handle 146. The other handle 148 has an elongated slot 160 receiving an inturned end or peg 161 of a spring bar 162. The other end of the spring bar is curved around the mounting pin 15 and has an inturned peg fitting in a hole of the cam and spacer plate 154.

Figure 24:
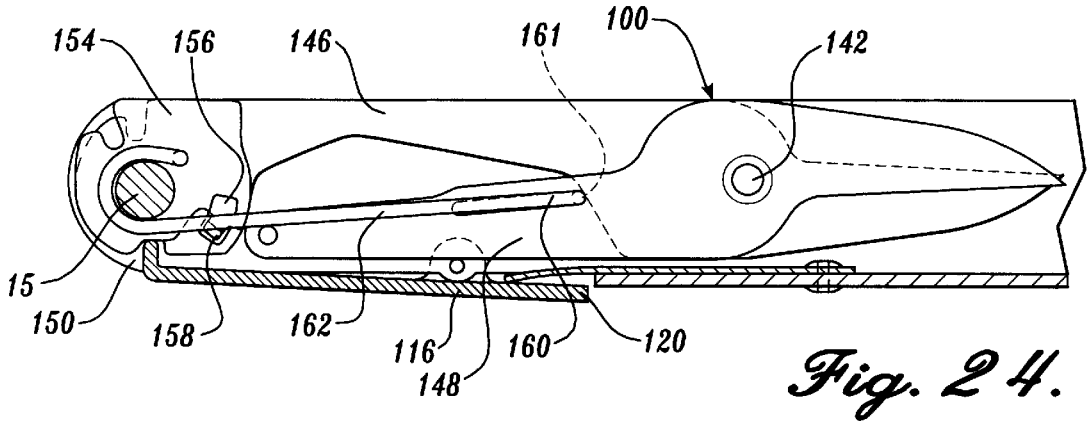
FIG. 24 is an enlarged fragmentary side elevation of an end portion of one of the handles of the tool of FIG. 20 with parts broken away to illustrate a scissors implement in accordance with the present invention.
Figure 25:
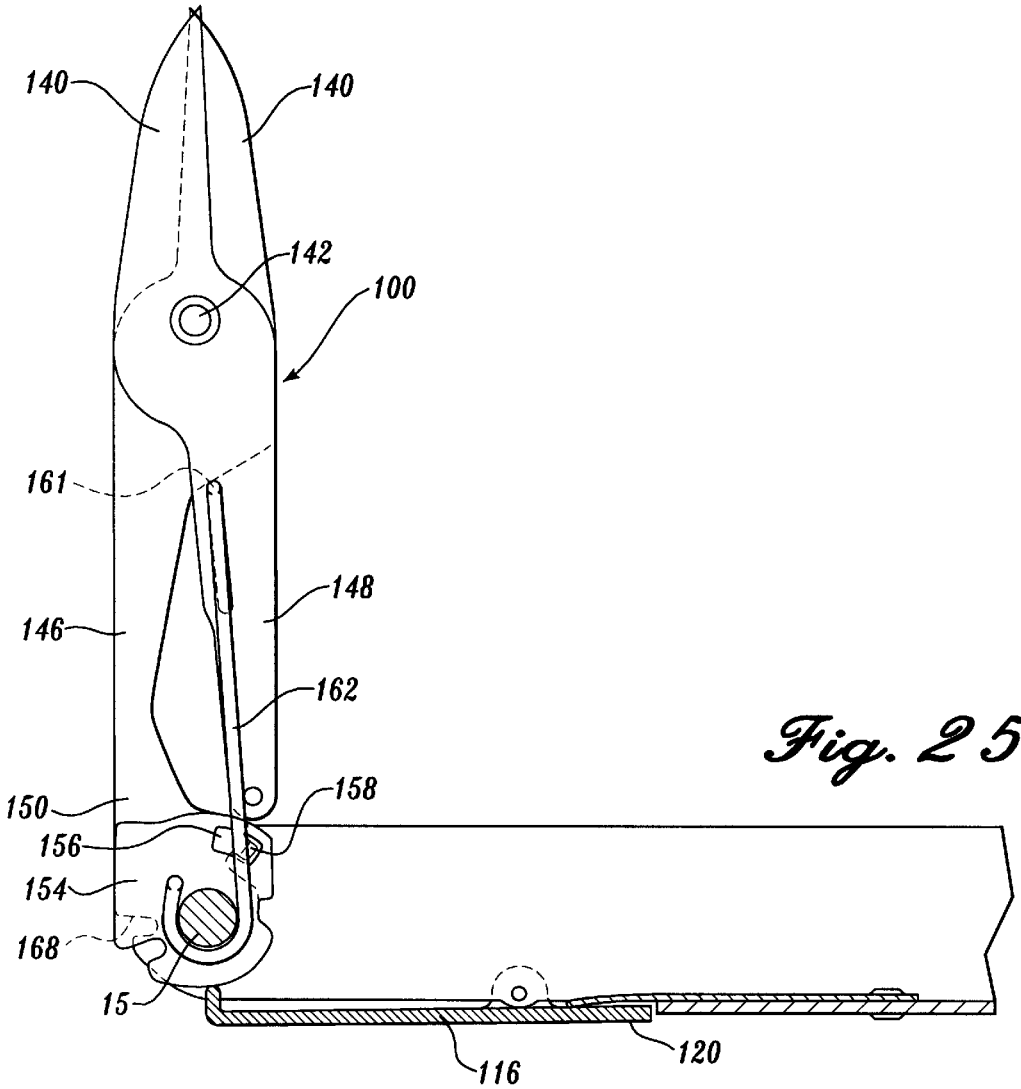
FIGS. 25, 26 and 27 are enlarged fragmentary side elevations corresponding to FIG. 21 but with parts in different positions.
Figure 26:
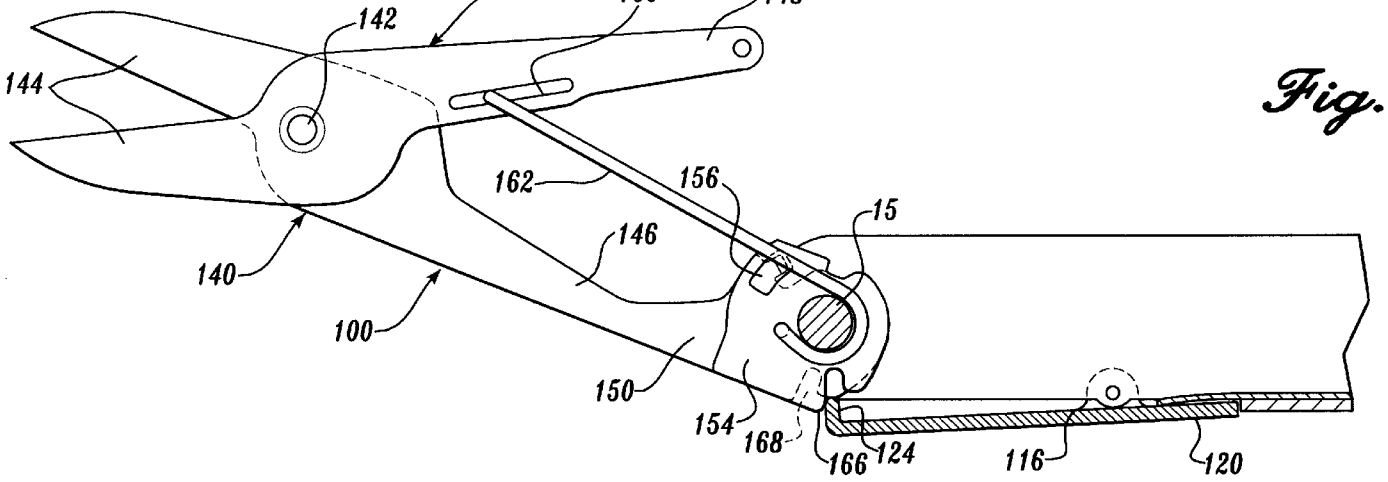
Figure 27:
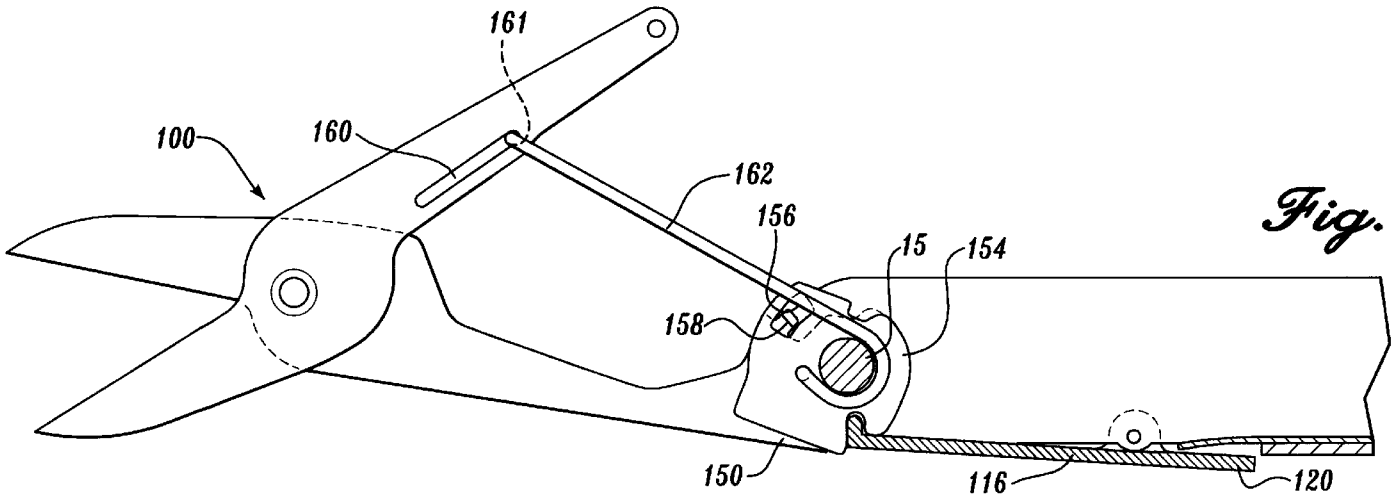

In the closed condition illustrated in FIG. 24, the peg 161 of the spring bar fits in or close to the end of slot 160 nearer to the scissors pivot 142, and the tab 158 of scissors handle 146 fits in the end of lost motion slot 156 nearer to the lock lever 116. In the closed condition, the spring bar tends to hold the scissors handles 146, 148 together. Similarly, as the scissors implement 100 is swung about the mounting pin 15, the spacer and cam plate 154 swings with the associated handle 146, as best seen in FIG. 25, and the scissors handles are biased together for maintaining the scissors jaws closed. However, eventually the position of FIG. 26 is reached, in which the lock finger 124 engages against a shoulder 166 of the spacer and cam plate 154. From this position as the implement is continued to be rotated, the handle 146 rotates relative to the spacer and cam plate, until the position of FIG. 27 is reached in which a notch 168 of the scissors handle 146 also receives the lock finger 124. During movement from the position of FIG. 26 to the position of FIG. 27, the handle 146 swings relative to the spacer and cam plate 154, and the tab 158 slides in the slot 156. Also, the attitude of the spring bar 162 relative to the scissors handles changes. The spring bar tends to be retained in a fixed position relative to the cam and spacer plate. Consequently, as the scissors handles swing relative to the plate 154, the end peg 161 of the spring bar slides rearward in the slot 160. An over center action occurs. When the fully opened position of FIG. 27 is reached, the scissors handles 146, 148 are biased apart, but can be brought together against the force of the spring rod 162 which acts similar to a leaf spring. This permits convenient operation of the miniature scissors since they are automatically returned to the open position after being manually closed for a cutting action.

To return the scissors implement to its nested position in the handle 77', the end 120 lock lever 116 is depressed which frees both the scissors handle 146 and spacer and cam plate 154 for rotation, counterclockwise as viewed in the figures. The scissors handle 146 at first moves relative to the spacer and cam plate 154, but eventually its tab 158 engages the opposite end of slot 156 so that the handle and plate swing together, and the scissors are once again biased to a position in which the handles are close together and the jaws or scissors blades are "closed".

Figure 28:
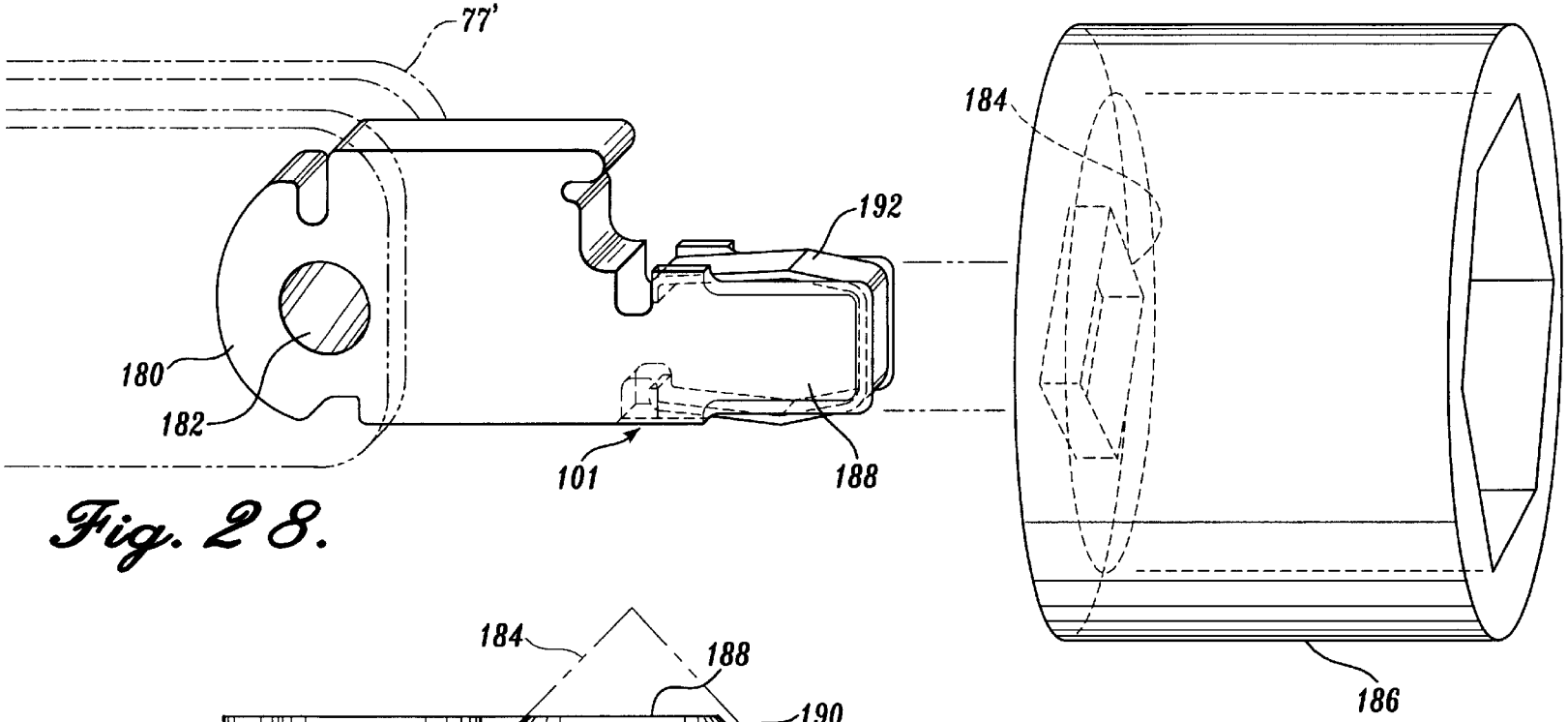
FIG. 28 is a side perspective of a specialized implement in accordance with the present invention.
Figure 29:
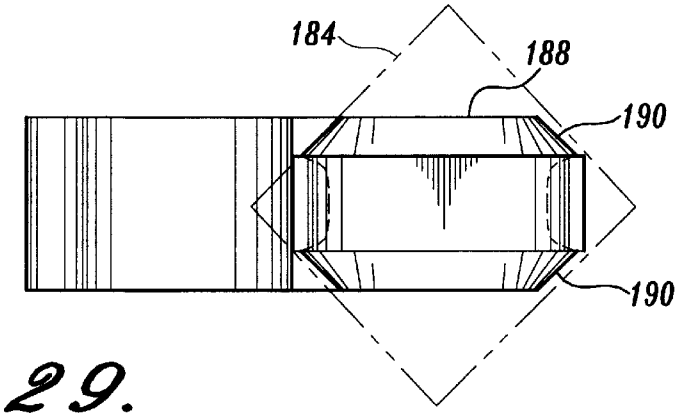
FIG. 29 is an end elevation of the implement of FIG. 28.

The specialized stud or driver implement 101 of FIG. 20 is shown in greater detail in FIGS. 28 and 29. Such implement includes a tang end 180 of the same contour as the end for the implement 72 shown in FIGS. 21–23, including the notches which interact with the lock lever. Hole 182 of the tang portion 180 receives the pivot pin which is common to all of the implements. FIG. 28 illustrates the implement 101 in the open position, ready for reception into the standard square end hole 184 of a conventional socket tool component 186. The projecting end portion 188 of implement 101 is shaped to fit closely in the square hole, but extending diagonally as best seen in FIG. 29. Thus, the opposite sides of the projecting portion 188 have 45° bevels 190 for engaging in opposite corner portions of the hole 184. A U-shaped spring bar extends along the top, end and bottom of the projecting portion 188 and is bowed along the sides indicated by 192 in FIG. 28 to releasably retain the stud 188 engaged in the square hole 184. Substantial torque can be applied, particularly when the implement 101 is moved to the open position (by opening the associated cover, swinging open the implement 101, and closing the associated cover) followed by closing the entire tool by swinging both of its long handles together. While a six-point box socket 186 is shown in FIG. 28, it should be recognized that implement 101 may be used with any socket type tool component having a standard square hole for a driver.

While the preferred embodiments of the invention has been illustrated and described, it will be appreciated that various changes can be made therein without departing from the spirit and scope of the invention.

The embodiments of the invention in which an exclusive property or privilege is claimed are defined as follows:

1. A tool comprising a pair of opposed jaw members, a first pivot swingably connecting the jaw members for movement relative to each other, each of the jaw members having a working end portion extending from the first pivot in a first direction and a butt portion extending from the first pivot in a second, generally opposite direction, two elongated handles each having a channel therein, the jaw members being moveable relative to the handles between an open position in which the jaw member working end portions are exposed and a closed position in which the jaw members are substantially nested in the channels of the handles, the channels of the handles opening outward, away from each other, when the handles are in the open position, at least one pocket knife implement swingably mounted in each of the channels and accessible through the channel opening, and two cover members, one for each of the handles, each cover member being mounted on its respective handle and being moveable relative thereto between an open position for access to the associated pocket knife implement and a closed position extending over the open side of the channel for grasping by a user to manipulate the handles and associated jaw members, the cover members having openings through which the jaw members pass when the handles are moved between the open and closed positions.

2. A tool comprising a pair of opposed jaw members, a first pivot swingably connecting the jaw members for movement relative to each other, each of the jaw members having a working end portion extending from the first pivot in a first direction and a butt portion extending from the first pivot in a second, generally opposite direction, two elongated handles each having a channel therein, the jaw members being moveable relative to the handles between an open position in which the jaw member working end portions are exposed and a closed position in which the jaw members are substantially nested in the channels of the handles, the channels of the handles opening outward, away from each other, when the handles are in the open position, and two cover members, one for each of the handles, each cover member being mounted on its respective handle and being moveable relative thereto between an open position for access to the associated channel and a closed position extending over the open side of the channel for grasping by a user to manipulate the handles and associated jaw members, the cover members having openings through which the jaw members pass when the handles are moved between the open and closed positions.

* * * * *